US005203730A

United States Patent [19]

Kuragaki

[11] Patent Number: 5,203,730

[45] Date of Patent: Apr. 20, 1993

[54] TILTING SYSTEM FOR OUTBOARD DRIVE UNIT

[75] Inventor: Naoyoshi Kuragaki, Hamamatsu, Japan

[73] Assignee: Yamaha Hatsudoki Kabushiki Kaisha, Iwata, Japan

[21] Appl. No.: 887,781

[22] Filed: May 22, 1992

[30] Foreign Application Priority Data

Jun. 7, 1991 [JP] Japan ..... 3-163751

[51] Int. Cl.[5] ..... B63H 5/12

[52] U.S. Cl. ..... 440/61; 440/53; 440/57

[58] Field of Search ..... 440/53, 49, 61, 57, 440/58, 59, 88, 89

[56] References Cited

U.S. PATENT DOCUMENTS

| | | | |
|---|---|---|---|
| 4,086,869 | 5/1978 | Woodruff | 440/61 |
| 4,642,058 | 2/1987 | Sullivan | 440/61 |
| 4,659,315 | 4/1987 | Bland et al. . | |
| 4,778,417 | 10/1988 | Mixon | 440/61 |
| 4,836,812 | 6/1989 | Griffiths | 440/61 |
| 4,842,559 | 6/1989 | Litjens et al. | 440/61 |
| 5,067,919 | 11/1991 | Okita . | |

FOREIGN PATENT DOCUMENTS 1-141192 6/1989 Japan .

*Primary Examiner*—Joseph F. Peters, Jr.
*Assistant Examiner*—Stephen P. Avila
*Attorney, Agent, or Firm*—Ernest A. Beutler

[57] ABSTRACT

A conduit arrangement in a hydraulic tilting system for an outboard drive unit wherein a plurality of connecting members are provided, one mounted at the lower end of the gimbal housing and two mounted on the outer periphery of the gimbal housing higher than the upper connecting member but lower than the tilt shaft on the gimbal ring. A pair of inboard conduits extend from a pressure source within the hull of the associated marine vessel to the lower connecting member while two pairs of intermediate conduits interconnect the lower connecting member with a respective one of the upper connecting members. There are two pairs of outboard conduits, each pair interconnecting one of the upper connecting members with a respective one of a pair of fluid motors which extend between the gimbal ring and the outdrive portion of the drive unit for effecting tilting and trimming movement of the outdrive. Each of the outboard hoses extend downward and outward from its corresponding upper connecting member to its associated fluid motor. The connecting members are situated to be easily accessible by hand for installation and servicing of the conduits, and the outboard conduits are arranged and configured to improve durability and so as not to interfere with other components.

6 Claims, 6 Drawing Sheets

TILTING SYSTEM FOR OUTBOARD DRIVE UNIT

BACKGROUND OF THE INVENTION

This invention relates to a tilting system for an outboard drive unit, and more particularly to an improved and advantageous arrangement of inboard and outboard conduits and connectors in a hydraulic tilting system which allows for easy servicing of the conduits and improves their durability, and wherein the outboard conduits will not interfere with other components of the drive unit.

As is well known, a variety of hydraulic systems have been employed for achieving tilt and trim movement of a marine outboard drive unit. These systems typically include a pair of reciprocating hydraulic or fluid motors, which are interposed between the transom of the associated marine vessel and the drive unit for adjusting the tilt and trim of the drive unit in response to extension and contraction of the fluid motors. The fluid motors are powered by a reversible fluid pump that is typically installed within the marine vessel and which circulates hydraulic pressure to and from the fluid motors through inboard conduits connected to the pump and outboard conduits connected to the fluid motors. Connectors are installed on the gimbal housing, which cooperates in supporting the drive unit on the transom of the marine vessel, to connect the inboard and outboard conduits with each other.

One such hydraulic system for an inboard/outboard drive unit has been disclosed in U.S. Pat. No. 4,659,315. In this system, the connector between the inboard and outboard conduits is disposed on the upper portion of the gimbal housing. The outboard conduits then extend downward from this connector for connection with the hydraulic piston/cylinder assemblies which extend between gimbal housing and the outboard drive unit. However, with the connector for the inboard and outboard conduits positioned on the upper portion of the gimbal housing above the tilt axis of the outdrive portion, it has been difficult to access the connector with hands, making installation and servicing of the conduits in the gimbal housing somewhat difficult.

Therefore, a system has been proposed in which the conduit connector is installed at the lower end portion of the gimbal housing, and the outboard conduits are arranged so as to extend upward and then downward to form a loop in the gimbal housing. Such a system is provided in Japanese Unexamined Patent Publication 1-141192. Positioning the connector portion in the lower end portion of the gimbal housing makes it more accessible and also makes installation and servicing of the conduits easier. However, this type of system has a disadvantage in that the looped outboard conduits within the gimbal housing may interfere with other components and may also have reduced durability due to the bending and contact with other components. Such a conduit configuration is also disadvantageous from the standpoint of appearance.

It is, therefore, a principal object of this invention to provide an improved hydraulic tilting system for an outboard drive unit which provides for easy installation and servicing of the conduits.

It is another object of this invention to provide an improved hydraulic tilting system for an outboard drive unit wherein the outboard conduits are arranged to improve their durability and so as not to interfere with other components.

It is a further object of this invention to provide an improved hydraulic tilting system which is advantageous from the standpoint of appearance and design.

SUMMARY OF THE INVENTION

This invention is adapted to be embodied in a hydraulic tilting system for an outboard drive unit pivotally attached to a support structure that is mounted on the transom of a marine vessel. The hydraulic tilting system comprises at least one fluid motor connected to the drive unit and the support member. There is disposed inboard of the marine vessel a pressure source for delivering hydraulic fluid to the fluid motor. In accordance with the invention, a first plurality of conduits in communication with the pressure source extend from inboard of the marine vessel to a first connecting member mounted on the support structure. A second plurality of conduits extend from the first connecting member to a second connecting member mounted on the support structure at a position higher than the first connecting member but lower than the point of pivotal attachment of the outboard drive unit to the support structure. The system also includes a third plurality of conduits which are outboard of the marine vessel and extend from the second connecting member to the fluid motor.

DETAILED DESCRIPTION OF THE PREFERRED EMBODIMENT OF THE INVENTION

Figure 1:
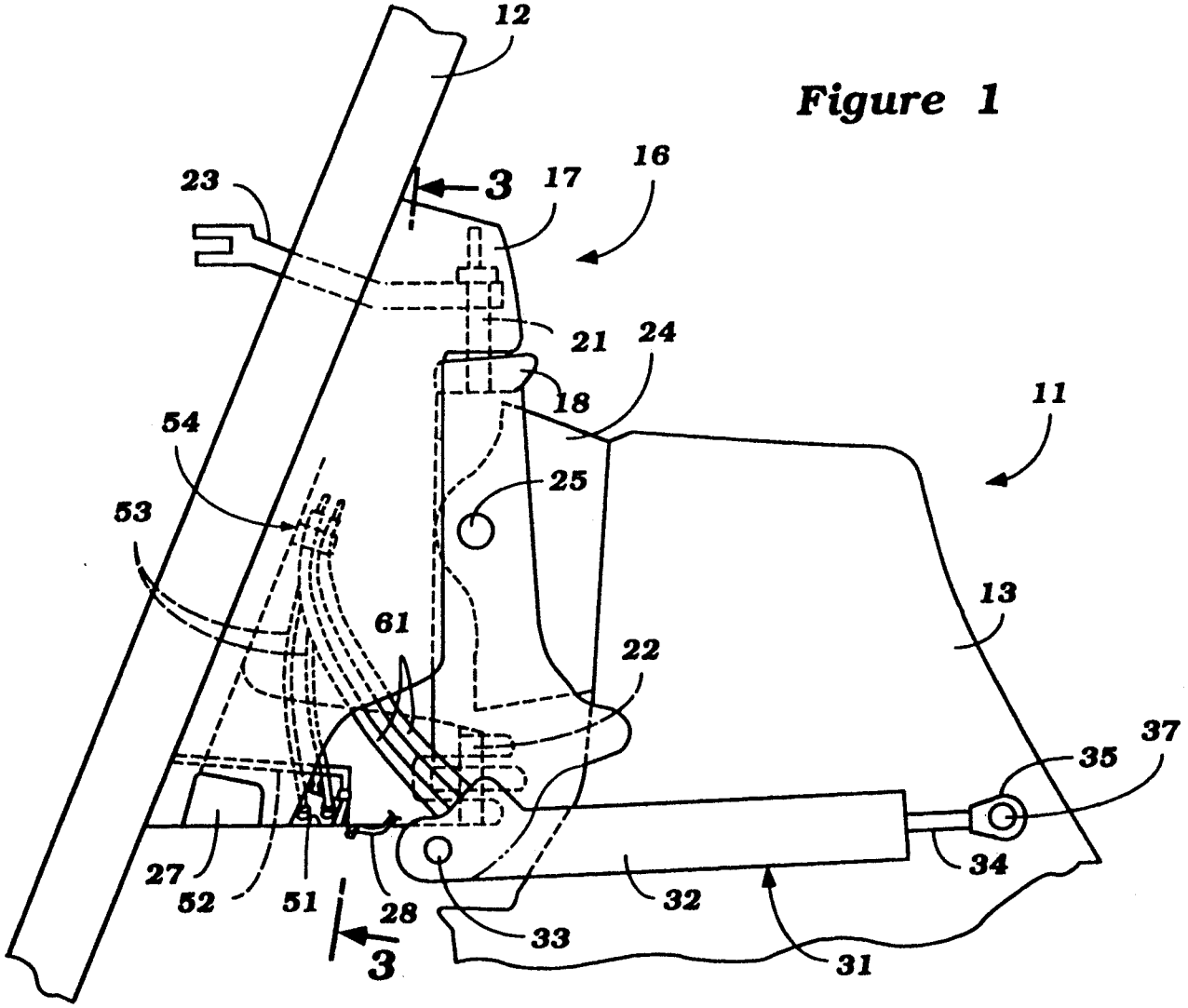
FIG. 1 is an enlarged side elevational view of an outboard drive unit attached to the transom of an associated marine vessel and constructed in accordance with an embodiment of the invention.
Figure 2:
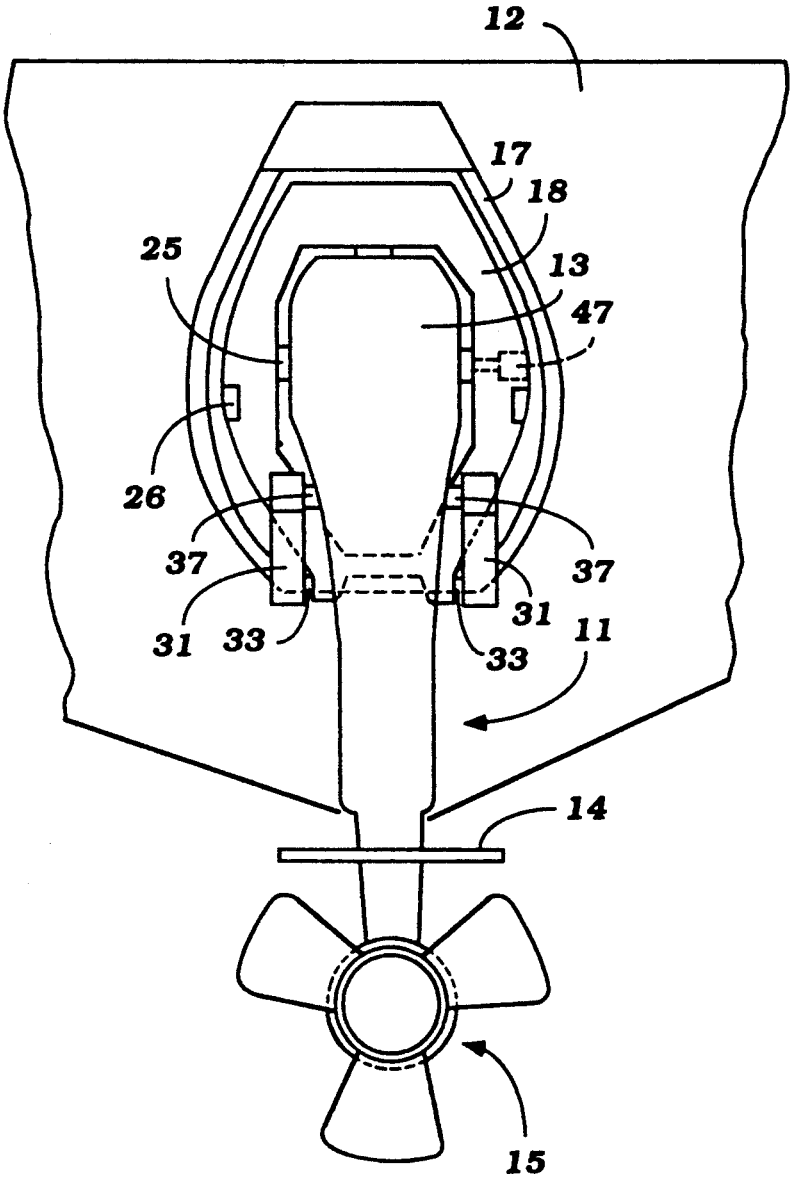
FIG. 2 is a rear elevational view of the outboard drive unit and a portion of the transom of the marine vessel.

Referring first to FIGS. 1 and 2, an outboard drive unit having a hydraulic tilting system constructed in accordance with an embodiment of the invention is identified generally by the reference numeral 11. The outboard drive unit 11 is, in the illustrated embodiment, of the inboard/outboard type which includes an internal combustion engine (not shown) secured within the hull of an associated marine vessel and an outdrive portion identified by the reference numeral 13 that is attached to the transom 12 of the hull of the marine vessel.

The engine drives an output shaft which extends generally horizontally through an opening in the transom 12 and is coupled to an input shaft of the outdrive portion 13 through a universal connection so as to accommodate steering and tilt and trim movement of the outdrive portion 13. The input shaft drives a forward, neutral, reverse transmission which may be of any known type and which is engaged with a driveshaft for driving it in selected forward or reverse directions. This driveshaft is journaled for rotation about a generally vertically extending axis in the outdrive portion 13. The driveshaft has affixed to its lower end a gear that drives a corresponding gear affixed to a propeller shaft that is journaled for rotation within a lower unit of the outdrive portion 13 below an anti-cavitation plate 14 that is formed on the outdrive portion 13 generally below the hull. A propeller 15 is affixed to the propeller shaft for propelling the marine vessel in selected forward or reverse directions.

The outdrive portion 13 further includes a support structure identified generally by the reference numeral 16. This support structure 16 comprises a gimbal housing 17 that is affixed to the transom 12 and which supports a gimbal ring 18 for steering movement of the outdrive portion 13 about upper and lower generally vertically extending pivot shafts 21 and 22 which are attached to the gimbal ring 18 and journaled for rotation within the gimbal housing 17. Steering movement is effected by a steering lever 23 that is secured on the upper pivot shaft 21. A swivel bracket 24 is mounted on the gimbal ring 18 by means of a tilt shaft 25 for tilt and trim movement and is adapted to support the outdrive portion 13 in a known manner. The gimbal ring 18 is provided with a detachable cover 26.

The gimbal housing 17 is provided with an electrode 27 at its lower portion. A grounding wire 28 electrically connects the gimbal housing 17 with the gimbal ring 18.

A pair of linear fluid motors, identified generally by the reference numeral 31, are provided, one on either side of the outdrive 13 portion for effecting tilt and trim movement of the outdrive 13. Each fluid motor 31 includes a cylinder housing 32 that is journaled at one end of the gimbal ring 18 by means of a pivot pin 33. A piston is slidably movable within each cylinder housing 32 and has connected to it a piston rod 34 which extends out the other end of its associated cylinder housing 32. At the remote end of each piston rod 34 is an enlarged connecting portion 35 which is removably connected to a projection 36 (see FIG. 4 on the side of the outdrive portion 13 by means of a support shaft 37.

Figure 3:
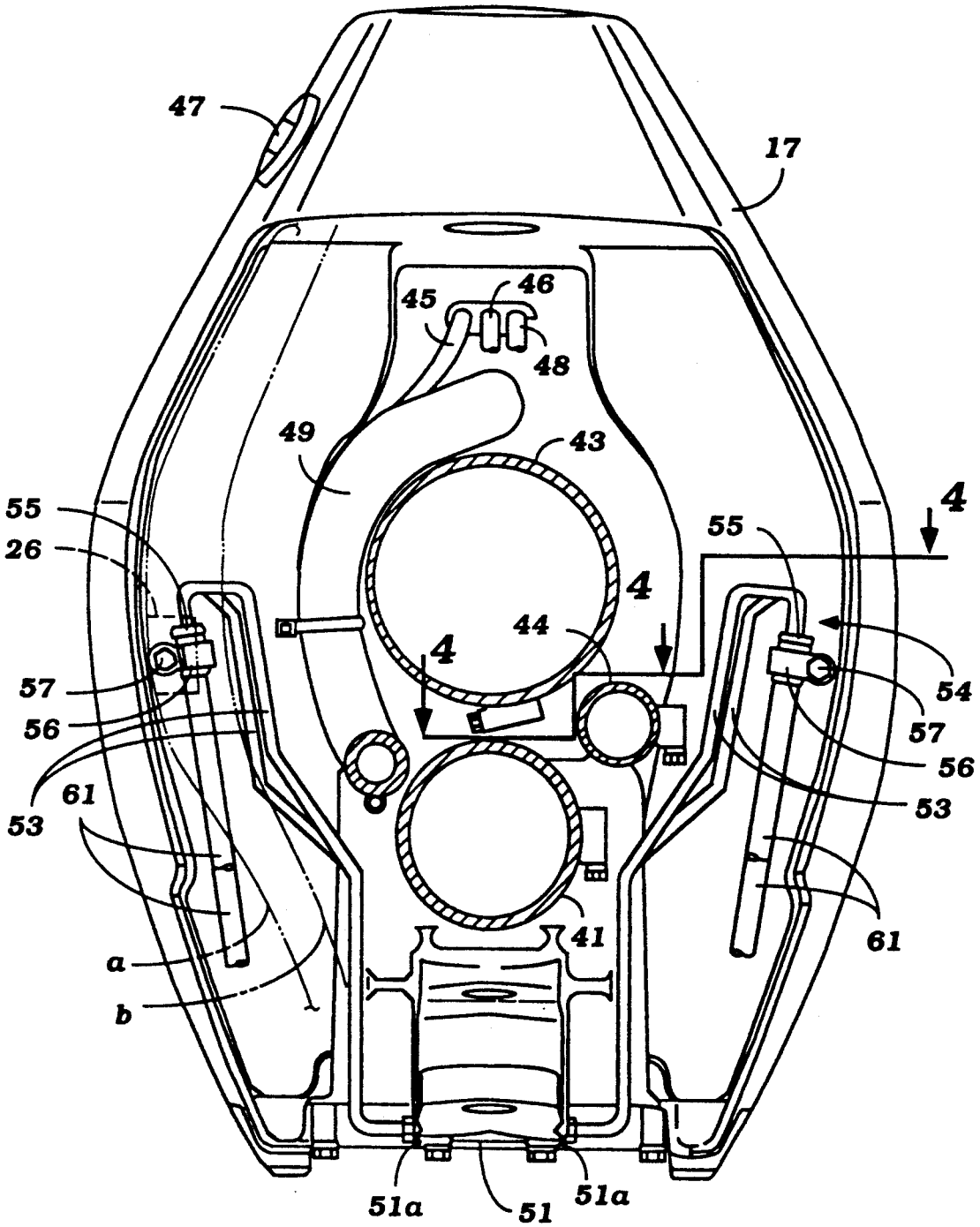
FIG. 3 is a cross-sectional view taken along lines 3—3 in FIG. 1.
Figure 4:
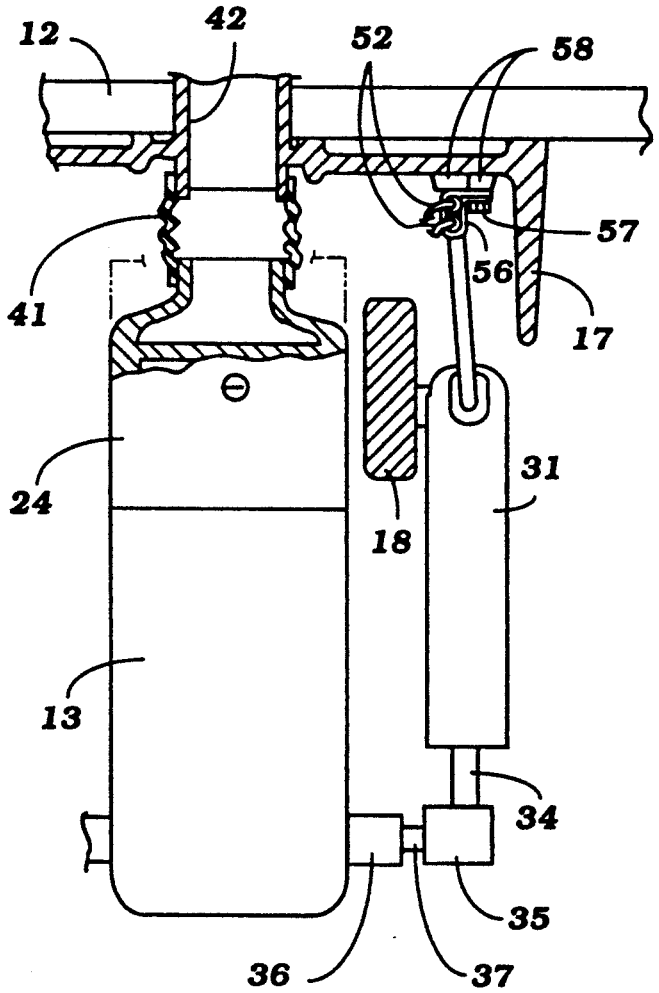
FIG. 4 is a cross-sectional view taken along lines 4—4 in FIG. 3.

Referring now to FIGS. 3 and 4, a flexible exhaust bellows 41 interconnects an exhaust passage 42, extending from the exhaust manifold of the engine through the transom opening, with an exhaust passage formed in the outdrive portion 13. Exhaust gases from the engine are discharged from the exhaust passage 42 through the exhaust bellows 41 and exhaust passage in the outdrive portion 13 and out an exhaust opening in the propeller 15.

A flexible bellows 43 is provided for covering and protecting the universal joint between the engine output shaft and input shaft of the outdrive portion 13. Similarly, a flexible bellows 44 covers the portion of the shift cable extending between the gimbal housing 17 and the swivel bracket 24. These bellows 43 and 44, as well as the exhaust bellows 41, may be disconnected from the outdrive portion 13 so that it may be disengaged from the transom 12.

Extending through the upper portion of the gimbal housing 17 in a generally horizontal row is a speedometer hose 45, a waterproof cable 46 for the trim limit switch 47 that is installed on the outer surface of the gimbal ring 18, and a waterproof cable 48 for the trim angle sensor. A cooling water hose 49 extends through the gimbal housing 17 below this row of components and runs downward along the outer periphery of the protective bellows 43. These resilient hoses 45 and 49 and cables 46 and 48 may be disconnected from the outdrive portion 13.

Referring now to FIGS. 1 and 3 through 5, the conduit and connector arrangement interposed between a pressure source in the hull of the marine vessel and the fluid motors 31 will be described in detail. A connecting member identified by the reference numeral 51 is mounted at the lower end of the gimbal housing 17 for communicating a first plurality of conduits 52 with a second plurality of conduits 53. The first plurality of conduits 52 is preferably comprised of a pair of flexible hoses which extend from within the hull of the marine vessel through the transom 12 to one end of the connecting member 51.

To the other end **51*a* of the connecting member 51, are connected the second plurality of conduits 53 which are, in the illustrated embodiment, two pairs of hydraulic pipes, one pair for each fluid motor 31, and which are preferably made of stainless steel. One of the pairs of pipes 53 are connected to one side of the lower end 51*a* of the connecting member 51 and extend upward in the gimbal housing 17 for connection at their other ends with one of a pair of connecting members, identified generally by the reference numeral 54. These connecting members 54 are installed on opposite sides of the gimbal housing 17 near its outer periphery at positions higher than the first connecting member 51 and higher than the pivot pins 33 on the hull side of the fluid motors 31 but lower than the tilt shaft 25. The other pair of pipes 53 are connected to other side of the end 51*a* of the connecting member 51 and also extend upward in the gimbal housing 17 for connection at their other ends with the other connecting member 54**.

Figure 5:
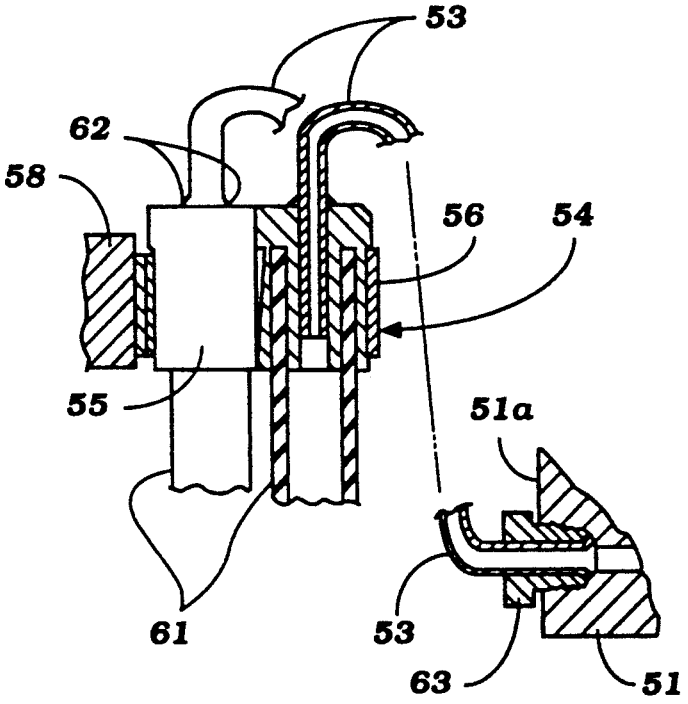
FIG. 5 shows the construction of the connecting members.

Each connecting member 54 includes a stainless steel connector 55 which is mounted by means of clamp 56 that is fastened by means of a bolt 57 on a boss portion 58 protruding from the inner wall of the gimbal housing 17. As shown in FIGS. 3 and 5, each pair of hydraulic pipes 53 extend outward from opposites sides of the connecting member 51, then upward, and are then bent rearward and downward after which they are connected to the upper end of one of the stainless steel connectors 55.

To the lower ends of the stainless steel connectors 55 are connected the upper end portions of a third plurality of conduits identified by the reference numeral 61 and comprised of two pairs of resilent outboard hoses. One pair of the hoses 61 extends from each connector 55 to a respective one of the fluid motors 31. Each of these hoses 61 is fitted into its respective connector 55 and within the associated clamp 56 so that the hoses 61 are held securely in place.

Each pair of outboard hoses 61 curves downwardly and rearwardly from the associated connector 55 toward the respective fluid motor 31. This curvature in the hoses 61 provides sufficient slack to allow the hoses 61 to easily follow the movement of the fluid motors 31. Moreover, with this arrangement, the outboard hoses 61 will not be looped within the gimbal housing 17. As a result, the hoses 61 will not likely interfere with other components which, in turn, will improve the durability of the hoses 61 Also, because the hoses 61 are accommodated in the gimbal housing 17, the hoses 61 will not likely be damaged by floating matter on the surface of the water. This arrangement also provides a neater appearance.

The details of the connecting members 51 and 54 are illustrated in FIG. 5. The connection area 62 between each stainless steel connector 55 and its associated hydraulic pipes 53 is sealed by brazing in the illustrated embodiment, whereas the hydraulic pipes 53 are connected to the lower end 51*a* of the connecting member 51 by means of hermetic plugs 63, one for each pipe 53. Each hermetic plug 63 has a bore formed therethrough for receiving one end of a corresponding hydraulic pipe 53 and has a hexagonal head at its top. Below the hexagonal head, each hermetic plug 63 has a threaded portion that is adapted to be threaded into a corresponding threaded bore formed in the lower end 51*a* of the connecting member 51. It will be seen that the end portion of each hydraulic pipe 53 received in the connecting member bore is tapered outward slightly and that the inner end of this bore is likewise tapered to accommodate the pipe 53. By way of this connection, the hydraulic pipes 53 are securedly joined to the lower end 51*a* of the connecting member 51.

The connections between the inboard hoses 52 and the connecting member 51 and the connections between the outboard hoses 61 and the fluid motors 31 may also utilize hermetic plugs and may be of a similar structure to that described above.

By placing the connecting members 54 lower than the tilt shaft 25, the members 54 are readily accessible when the outdrive portion 13 is tilted up. There is also ample space in the gimbal housing 17 below the tilt shaft 25 in which to work. With this tilting system arrangement, once the outdrive portion 13 is tilted up, the detachable cover 26 (shown in phantom in FIG. 3) may be readily removed from the gimbal ring 18 to expose the connectors 55 and associated bolts 57, making them easily accessible by hand for connecting or disconnecting the outboard hoses 61. Alternatively, the gimbal ring 18 may be pivoted from a non maximum steering state, such as its straight steering state indicated by the broken line a in FIG. 3, to its maximum steering state indicated by the broken line b in FIG. 3 when the outdrive portion 13 is in its tilted down position. This will expose one of the connectors 55 and its associated bolt 57. Turning the gimbal ring 18 to its maximum steering state in the other direction will expose the other connector 55 and its bolt 57. With the connector(s) 55 exposed, the associated bolt(s) 57 can then be easily removed from the boss portion 58 of the gimbal housing 17 with a socket wrench or the like and the outboard hoses 61 installed or disconnected.

Moreover, by disconnecting one of the pairs of hydraulic pipes 53 from the connecting member 51 and disconnecting the corresponding pair of outboard hoses 61 from the fluid motors 31, that pair of hydraulic pipes 53, associated connector 55 and corresponding outboard hoses 61 may be taken out as a single unit.

Figure 6:
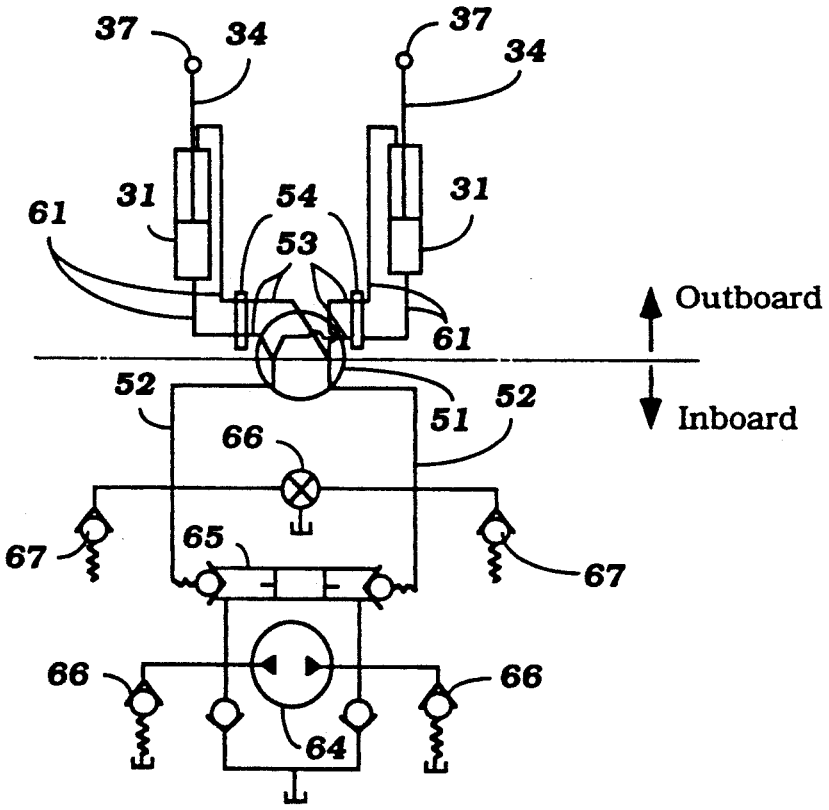
FIG. 6 is a schematic hydraulic circuit diagram arranged in accordance with an embodiment of the invention.

FIG. 6 shows the hydraulic circuitry for the tilting system. Contained within the hull of the marine vessel is a pressure source in the form of a reversible fluid pump 64. The pump 64 has a pair of ports that serve selectively as pressure or return ports depending on whether the outdrive portion 13 is being tilted or trimmed up or trimmed down. The ports communicate with a shuttle valve assembly, indicated by the reference numeral 65, which includes a shuttle piston and a pair of check valves. The shuttle piston has projections that are adapted to unseat the check valves in operation of the system.

A pair of pressure responsive relief valves 66 are provided, one in communication with each pump port, to permit flow of fluid back to a reservoir in the event a high pressure condition exists in the system. In a like manner, a check valve associated with each pump port permits return flow to the system for make up purposes.

When the pump 64 is operated so as to deliver hydraulic to and thereby pressurize the port to the right of the pump 64 as seen from FIG. 6, the pressure in the shuttle valve assembly 65 will effect movement of the shuttle piston to the left to open the check valve on that side. The pressure in the shuttle valve assembly 65 also causes the check valve on the right to unseat and open communication with the first conduit 52 on the right that extends to the connecting member 51. As previously noted, the connecting member 51 communicates that first conduit 52 with a pair of hydraulic pipes 53, one of which extends to each connecting member 54. The connecting members 54, in turn, each communicate its respective hydraulic pipe 53 of this pair with a corresponding one of the outboard hoses 61 that extend to the chambers on the piston rod sides of the fluid motors 31 respectively. This will effect contraction of the piston rods to cause trim down operation of the outdrive portion 13.

During this operation, fluid is discharged from the chambers on the piston sides of the fluid motors 31 through the other pair of outboard hoses 61 to their respective connecting members 54 and through the corresponding hydraulic pipes 53 to connecting member 51. From there, the hydraulic fluid flows through the first conduit 52 on the left for return to the shuttle valve assembly 65. The fluid returns through the open check valve on the left of the shuttle valve assembly 65 to the port on the left of the pump 64 so as to provide return fluid for the system.

For tilt or trim up operation, the pump 64 is driven in the opposite direction to pressurize the left side port and cause the shuttle piston of the shuttle valve assembly 65 to move to the right, opening the check valve on that side so that the right side port acts as a return port. The fluid pressure in the shuttle valve assembly 65 will open the check valve on the left and then flow through the first conduit 52 on that side to the connecting member 51. The fluid is then delivered to the chambers on the piston sides of the fluid motors 31 through the corresponding hydraulic pipes 53 and outboard hoses 61 to cause trim or tilt up movement of the outdrive portion 13. In this case, the other pairs of outboard hoses 61 and hydraulic pipes 53 and the right side conduit 52 act as return lines.

The hydraulic system further includes a relief valve 66 embodied in a manual bypass valve assembly positioned in the conduit system so as to relieve hydraulic pressure in the system in the event that the outdrive portion 13 collides with an obstacle or the system otherwise experiences high pressure. The relief valve 66 is positioned in the hydraulic system so that it can relieve impact loads in either direction. This bypass valve assembly includes a bypass conduit that extends between the left and right side first conduits 52 and incorporates the relief valve 66. The bypass conduit includes a pair of check valves 67 that permit flow from the left and right first conduits 52 to the bypass valve assembly conduit and relief valve 66 but not flow in the opposite direction. Thus, high pressure in any of the fluid motor chambers can be relieved through the single relief valve 66.

It should be readily apparent from the foregoing description that an improved and advantageous conduit and connector arrangement in a tilt system for an outboard drive unit has been illustrated and described. Although an embodiment of the invention has been illustrated and described, various changes and modifications may be made without departing from the spirit and scope of the invention, as defined by the appended claims. For example, the hydraulic pipes 53 may be removably connected to the connectors 55 instead of brazing them together and to affix the pipes 53 to the inside wall of the gimbal housing 17. In this case, the outboard hoses 61 may still be easily connected or disconnected from connectors 55 and this may be done without disconnecting the pipes 53 from the connectors 55.

I claim:

1. A hydraulic tilting system for an outboard drive unit pivotally attached to a support structure that is mounted on a transom of a marine vessel, comprising at least one fluid motor connected to said drive unit and said support structure, a pressure source inboard of said marine vessel for delivering hydraulic fluid to said fluid motor, a first connecting member mounted on said support structure, a first plurality of conduits in communication with said pressure source and extending from inboard of said marine vessel to said first connecting member, a second connecting member mounted on said support structure at a position higher than said first connecting member but lower than the point of pivotal attachment of the outboard drive unit to the support structure, a second plurality of conduits extending from said first connecting member to said second connecting member, and a third plurality of conduits outboard of said marine vessel and extending from said second connecting member to said fluid motor.

2. A hydraulic tilting system as recited in claim 1, wherein each conduit of said second plurality of conduits extends upward from said first connecting member and is connected to the upper end of said second connecting member.

3. A hydraulic tilting system as recited in claim wherein each conduit of said third plurality of conduits is flexible and is connected to the lower end of said second connecting member.

4. A hydraulic tilting system as recited in claim 3, wherein each conduit of said third plurality of conduits extends downward therefrom and curves rearward toward said fluid motor.

5. A hydraulic tilting system as recited in claim 2, further comprising a plurality of hermetic plugs, one for connecting each conduit of said second plurality of conduits to said first connecting member.

6. A hydraulic tilting system as recited in claim 1, wherein said support structure comprises a gimbal housing and wherein said third plurality of conduits is accommodated within said gimbal housing.

* * * * *

UNITED STATES PATENT AND TRADEMARK OFFICE

CERTIFICATE OF CORRECTION

PATENT NO. : 5,203,730

DATED : April 20, 1993

INVENTOR(S) : Naoyoshi Kuragaki

It is certified that error appears in the above-indentified patent and that said Letters Patent is hereby corrected as shown below:

Column 8, line 13, Claim 3, after "claim" insert --1--.

Signed and Sealed this

Eighth Day of February, 199

Bruce Lehman

*Attest:*

BRUCE LEHMAN

*Attesting Officer*

*Commissioner of Patents and Trademarks*